United States Patent [19]

Tyrer

[11] Patent Number: 4,583,901

[45] Date of Patent: Apr. 22, 1986

[54] GATES FOR SELF UNLOADING VESSELS

[75] Inventor: Vaughan Tyrer, St. Catharines, Canada

[73] Assignee: ULS International Inc., Toronto, Canada

[21] Appl. No.: 617,933

[22] Filed: Jun. 6, 1984

[51] Int. Cl.[4] ..... B65G 65/70

[52] U.S. Cl. ..... 414/144; 105/280; 198/532; 198/533; 222/199; 222/502; 298/24

[58] Field of Search ..... 414/144, 266, 267, 268, 414/288; 222/166, 199, 226, 243, 247, 248, 404, 408.5, 502, 533–536; 105/280, 282 R; 198/532, 533; 298/24, 25, 27, 28, 30

[56] References Cited

U.S. PATENT DOCUMENTS

| | | | |
|---|---|---|---|
| 912,887 | 2/1909 | Pool | 198/530 |
| 1,258,397 | 3/1918 | Crawford | 198/533 |
| 1,258,420 | 3/1919 | Koenig | 198/530 |
| 1,555,297 | 9/1925 | Kreisinger | 414/199 |
| 2,815,134 | 12/1957 | Borrowdale | 198/533 |
| 2,901,281 | 8/1959 | Martins | 298/25 X |

FOREIGN PATENT DOCUMENTS

| | | | |
|---|---|---|---|
| 753720 | 8/1980 | U.S.S.R. | 222/199 |

*Primary Examiner*—Leslie J. Paperner
*Attorney, Agent, or Firm*—Bachman & LaPointe

[57] ABSTRACT

Apparatus for handling particulate material such as is stored in a hopper having an elongated throat opening closed by one or more gates. The gates are mounted at one end thereof from axially aligned rails which are preferably mounted outside the hopper on each lateral side of the throat opening. The other end of the gate is arcuately formed in axial cross section, and is supported on structure, preferably including rollers, bridging the throat opening transversely. As the gate is moved along the track, the other end moves upwardly and forwardly in the hopper, and will dig into and break up arches and rat holes and other formations within the hopper to promote flow through the gate.

30 Claims, 8 Drawing Figures

GATES FOR SELF UNLOADING VESSELS

FIELD OF INVENTION

This invention relates to apparatus for handling particulate material such as may be stored or transported in large hoppers. As used herein the term hopper is intended to cover conventional hoppers having wall structure and a throat opening thereto through which the particulate material is discharged. It is also intended to cover structure wherein the particulate material is merely piled above a discharge opening.

BACKGROUND OF INVENTION

In discharging particulate material from hoppers, it is not uncommon for the particulate material to form relatively stable formations such as arch formations, domes, bridges and rat holes, which act to prevent the efficient discharge of the particulate material from the hopper. Various methods have been heretofore proposed for breaking up the formations. In copending U.S. application Ser. No. 404,544 filed Aug. 2, 1982, to Pole, commonly assigned herewith, the hopper openings are controlled by one or more gates which are swingable about pivot points to move within the hopper outside of the boundary of the hopper opening controlled by the gate, whereby they can dig into and break up the formations. Generally speaking this necessitates the gates being suspended from within the hopper, which may itself promote the formations spoken of to some extent. Also, it will be appreciated that in certain instances, such as where the particulate material is coal or rock, the particles may be of a relatively large size, whereby gate supporting structure which locates within the hopper may be subject to undue stress and damage.

Where the gate is required to open by movement into the hopper, there is a considerable resistance to such movement until such time as the particulate material commences to be discharged through the gate, and the energy requirements to open the gate in the initial stages are therefor high. As a corollary, the equipment required to generate and transmit the opening forces must be relatively massive, thereby leading to increased costs and size.

It is desirable that the load on the gate act at all times in a manner to urge the gate to a closed position whereby the gate will tend to close in the event of a power failure. On the other hand, there is advantage in a gate system which will remain partially open without necessitating the continuous application of power to maintain it in its open position. Where the particulate material acts to urge the gate to open, it is desirable that means for locking the gate be provided.

It is a prime object of this invention to provide improved apparatus for handling particulate material.

It is another object of the invention to provide hoppers and gate structure therefor.

It is a further object of the invention to provide apparatus of the aforesaid nature wherein the gate supporting structure may locate predominately outside of the hopper.

It is yet another object of the invention to provide gate structure which may assume a stable, partially open position.

It is still a further object of the invention to provide gate structure which may be locked shut.

BRIEF DESCRIPTION OF THE INVENTION

In accordance with one aspect of my invention, in a hopper which includes an axially elongated throat opening therein through which particulate material is to be discharged, an axially aligned track is provided. At least one gate is provided for at least partially closing the throat opening, one end of the gate being mounted from the track and movable therealong. The other end of the gate is supported by means whereby as the one end is moved in a direction to open the gate, the other end moves upwardly within the hopper whereby the leading edge thereof will dig into the particulate material to break up and dislodge formations which prevent flow through an adjacent gate. Preferably, the track locates outside the hopper, on the discharge side of the gate, and is placed so as not to be subject to potentially damaging impact from particulate material flowing from the hopper.

The means supporting the other end of the gate so as to cause it to move upwardly within the hopper may be a prime mover such as a hydraulic or pneumatic cylinder. In a preferred embodiment of the invention the other end is supported on a cam surface so that as the one end is moved in a more or less horizontal manner along the track, the cam partially translates the movement to a vertical movement.

Conveniently the cam surface forms a part of the gate, which rides on a lateral bridging element such as is provided in the throat opening between adjacent gates, the one end of a one gate and the other end of an adjacent gate sealing on the bridging element. Desirably the bridging element is provided with one or more rollers upon which the cam surface rides. The term "bridging element" is intended to include not only those elements provided between adjacent gates, but also a lateral boundary defining the throat opening.

Preferably, means is also provided which will limit the degree of rotary movement of the other end of the gate within the hopper when the gate is subject to high impact forces caused, for example, by the sudden recommencement of flow through an open gate. The cam surface may be captively held between opposing rollers for example. Conveniently, at least where the hopper is of a traditional form having walls which converge towards the throat opening, finger elements may be supported from those walls to form a limit stop of the vertical travel of the other end of the gate.

In accordance with a preferred embodiment, a wheeled carriage is provided for movement along the track, the one end of the gate being mounted from the track by the wheeled carriage. Preferably, the carriage and track have cooperating elements which resist the displacement of the carriage from the track in both the vertical and horizontal directions.

Expediently, the gate is connected to the carriage by means which permit the one end of the gate to pivot relative to the carriage. Desirably, the gate connects to the carriage by means which permits the one end of the gate to be raised and lowered somewhat. In a preferred embodiment, the gate is connected to the carriage by a toggle which has an over-centre movement serving to lock and unlock the gate, and also to swing the one end of the gate downwardly to partly open the gate prior to any substantial travel of the gate upwardly and inwardly within the hopper. It is found that important advantages ensue therefrom in lower energy requirements to open the gate. While the toggle arrangement is preferred, other arrangements for producing similar effects may also be utilized and may under certain circumstances be preferred.

My invention will be further described in relation to preferred embodiments thereof, in conjunction with the annexed drawings wherein:

DESCRIPTION OF THE PREFERRED EMBODIMENT

Figure 1:
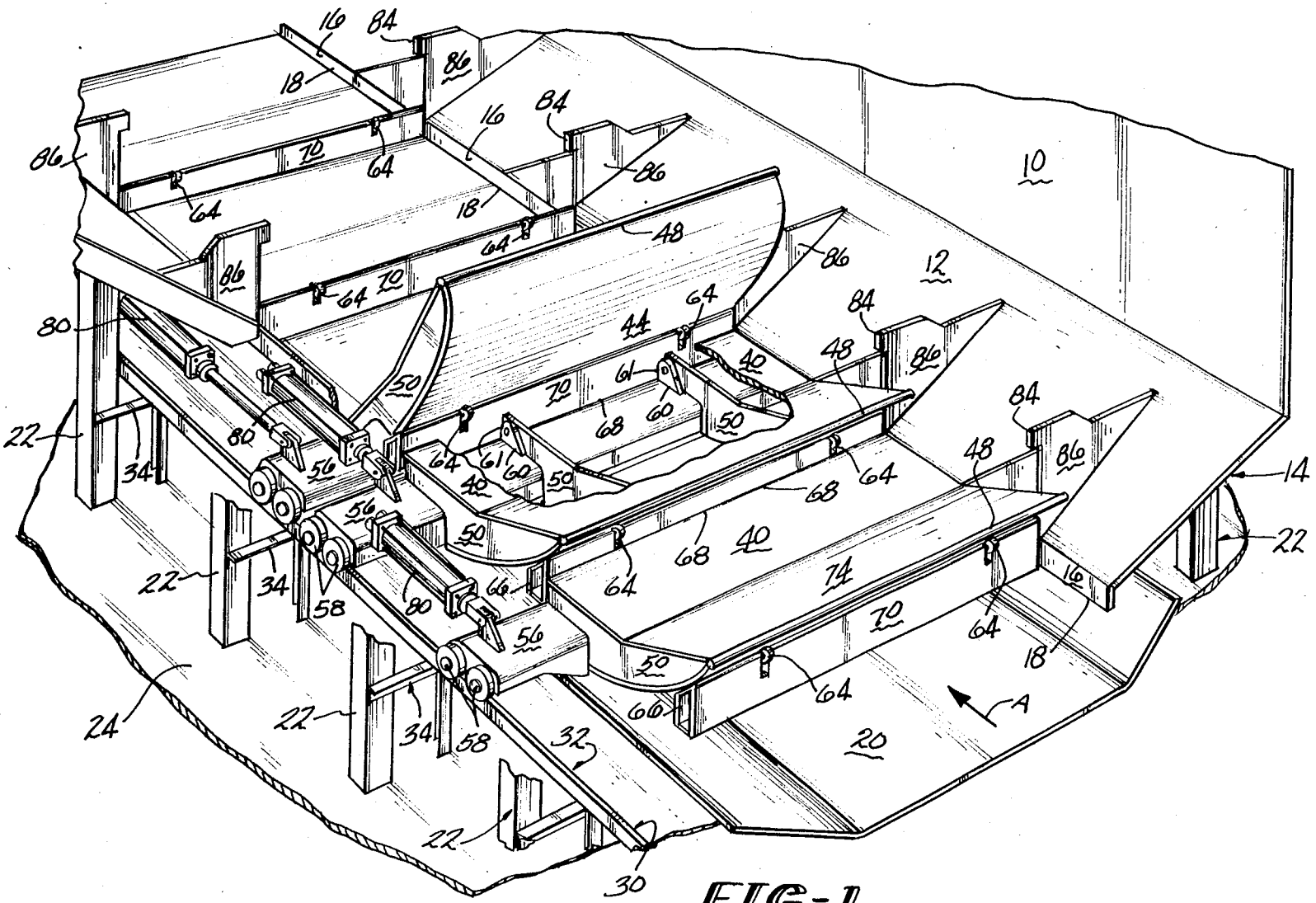
FIG. 1—shows in perspective view a portion of a hopper incorporating gate structure in accordance with the invention, broken away to reveal detail.

Referring to the drawings in detail, apparatus for the handling of particulate material, as exemplified by a self-unloading vessel, comprises wall structure including upper wall portions 10 which here form the hull walls of the vessel, and lower wall portions 12 which are inwardly convergent, together forming a hopper 14. Lower wall portions 12 terminate in downward flanges 16 to define a throat opening 18, which throat opening may extend axially for the length of a hold of the vessel.

Figure 2:
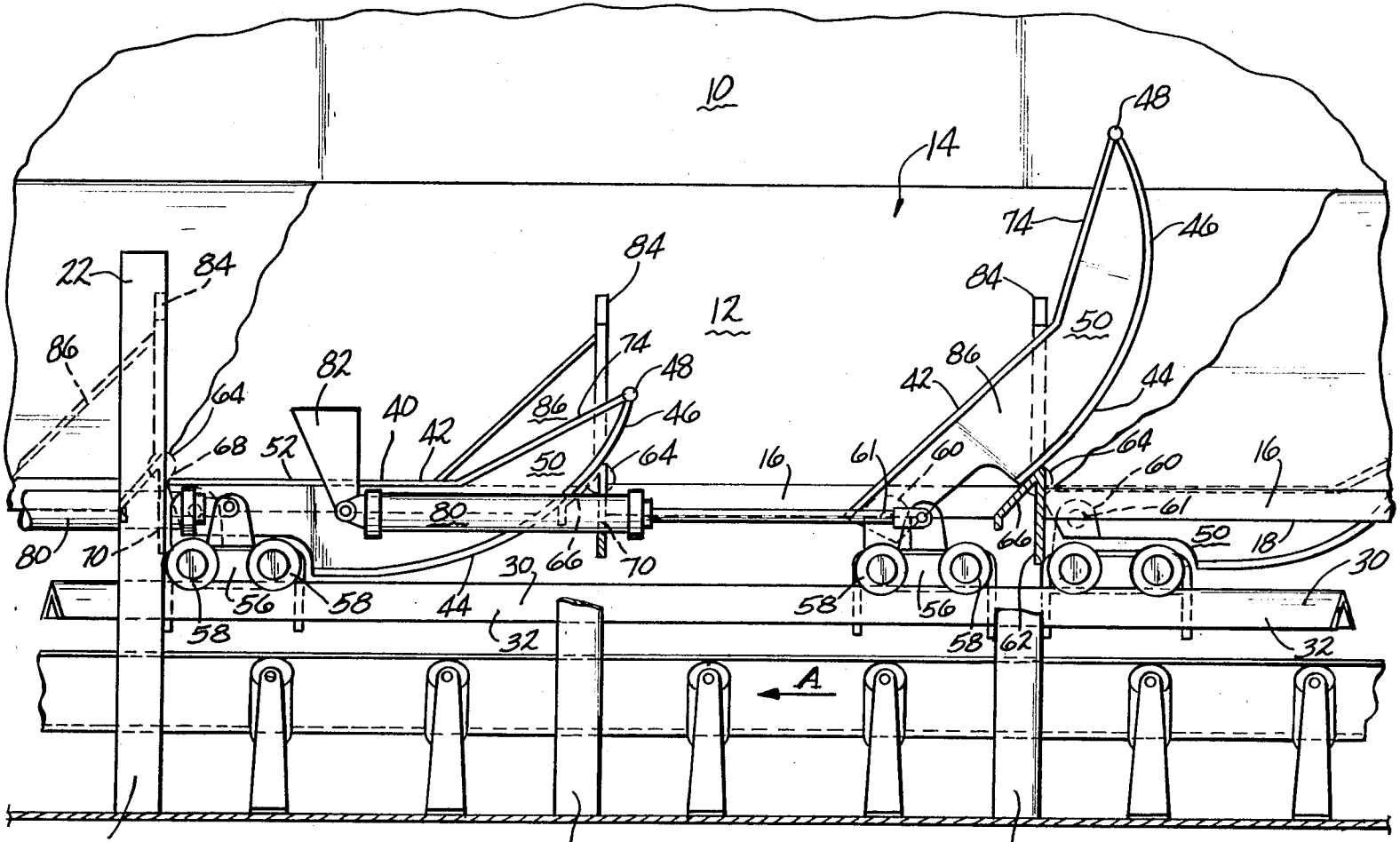
FIG. 2—is similar to FIG. 1 shown in side elevation.

Locating directly beneath throat opening 18 is an axially extending endless conveyor belt 20 which moves in the direction of the arrow A of FIGS. 1 and 2 and which serves to remove particulate material discharged from hopper 14 through throat opening 18. The wall structure further comprises a plurality of vertical support members 22 which span between the floor 24 of the vessel and the lower wall portions 12.

A pair of rails 30 locate respectively on each lateral side of throat opening 18 and extend coextensively therewith, together forming a track 32. Rails 30 are supported by wall structure comprising knees 34 located at axially spaced apart intervals.

A plurality of gates 40 close throat opening 18. Gates 40 comprise a gate floor 42 and a sub floor 44 which are generally coextensive with the width of throat opening 18. Sub floor 44 has lesser axial extent than the gate floor, and is spaced apart therefrom adjacent mid axial portions of the gate. The forward end 46 of sub floor 44 forms a part cylindrical surface having a radius about $\frac{2}{3}$ of the axial length of the gate 40 and centred on an imaginary axis located vertically above the gate at about $\frac{1}{2}$ the length thereof, and joins the gate floor 42 at the forward edge 48 of the gate at any acute angle. A plurality of axially aligned ribs 50 are sandwiched between the floor 42 and sub floor 44 to reinforce the gate 40.

Figure 3:
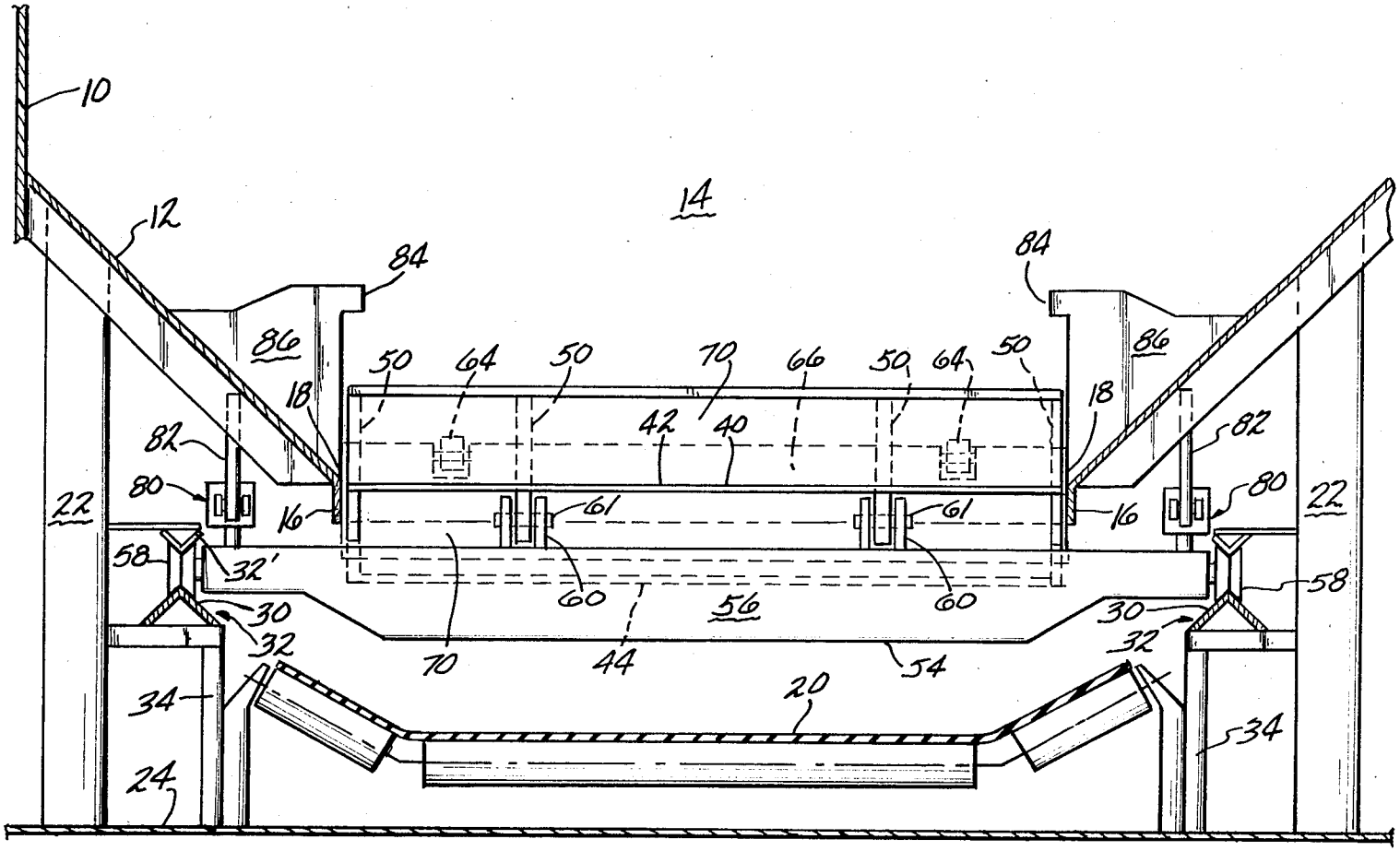
FIG. 3—is similar to FIG. 1 shown in end elevation, i.e. from the left hand side of FIG. 2.

The rearward end 52 of gate 40 is supported upon a carriage 54 which rides on track 32. Carriage 54 comprises a lateral beam 56 which spans between the opposed rails 30 above the level of conveyor belt 20, and wheels 58 which are rotatably mounted at the lateral ends of beam 56. Wheels 58 and rails 30 have complementary engaging surfaces best seen in FIG. 3, so as to resist the lateral displacement of the carriage 54 on track 32. Pairs of lugs 60 are upwardly formed on beam 56, and connected by pivots 61 to ribs 50 adjacent the rearward ends thereof.

The forward end 46 of gate 40 is supported by rollers 64 which mount on from a hogbacks 62 which bridge across throat opening 18 adjacent the forward end of the gates. Such hogbacks may be of limited axial extent in comparison to traditional hogbacks utilized in conjunction with traditional sliding gates, which is to say they do not unnecessarily restrict throat opening 18.

The forward end 46 of sub floor 44 of gate 40 when in its closed position contacts the rearward facing surface of hogback 62 tangentially to provide a seal therebetween. The rear edge 68 of a one gate generally abuts the forwardly facing surface 70 of hogback 62 supporting the forward end of an adjacent gate, so as to form a seal therewith. The forward end 74 of the gate is somewhat upwardly inclined so as not to interfere with the rearward end of an adjacent gate.

Each gate 40 is provided with a pair of hydraulic cylinders 80 which connect between carriage 54 and a fixed mount 82 securing to the underside of lower wall portions 12. The gates 40 are individually operable by means of individual control lines distinguished in FIG. 1 for the three gates shown therein as 83*a*, 83*b* and 83*c*. As cylinders 80 associated with any particular gate are actuated to open the gate, carriage 54 is moved forwardly along track 32. The shaped forward end 46 of sub floor 44 acts as a cam to translate the generally horizontal movement of the carriage 54 to provide a substantial degree of vertical movement of the forward edge 48 of the gate 40. Thus, as seen particularly in FIG. 2, as the gate moves towards its open position the edge 48 thereof described an arcuate movement vertically above the forwardly adjacent gate opening. Assuming that discharge of particulate material from the open gate of FIG. 2 ceased, or that it was reduced due to bridge or rat hole formation or the like, the adjacent downstream gate, i.e. that to the left of the open gate of FIG. 2, would be actuated to the open position in order that the end 48 thereof could break-up the formation and promote flow.

Since the forward end 46 of sub floor 44 of gate 40 merely rests upon rollers 64, and since the rearward end of the gate is pivotally supported from carriage 54, it is desirable to provide means for controlling the degree of rotation of gate 40 about its pivot support. Such means conveniently comprises laterally opposed pairs of finger elements 84 which are supported from lower wall portions 12 within hopper 14 by triangular gussets 86, so as to project within the lateral margins of throat opening 18 vertically above the forward end of a gate 40. As the gate rotates, for example under the pressure of particulate material being discharged through the gate, the floor 42 of the gate adjacent the forward end of the gate will contact the finger elements 84 to limit the rotation. There may be, in addition, a tendency of gate 40 when in its open position to rotate about rollers 64 under the influence of the weight of particulate material being discharged from hopper 14. Such rotation would act to raise the rearward end 52 of gate 40, thereby tending to displace carriage wheels 58 vertically whereby they may be displaced from track 30. Preferably, means is provided for resisting such vertical displacement, for which purpose there is provided a second track 32' supported from support members 22 above track 32 and comprising rails 30' which engage the upper grooved surface of wheels 58.

Figure 4:
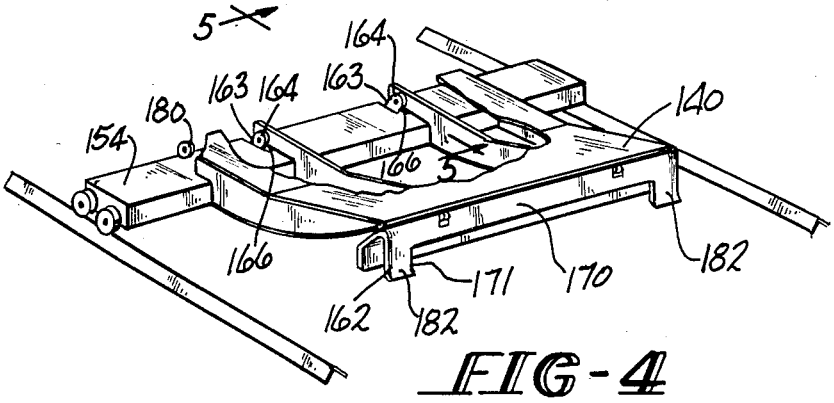
FIG. 4—is a similar view to a portion of FIG. 1 and shows a modified gate structure cut away to reveal detail, and FIGS. *5a–d*—are elevational views along 5—5 of FIG. 4 and shows in schematic form the operation of the modified gate structure.
Figure 5A:
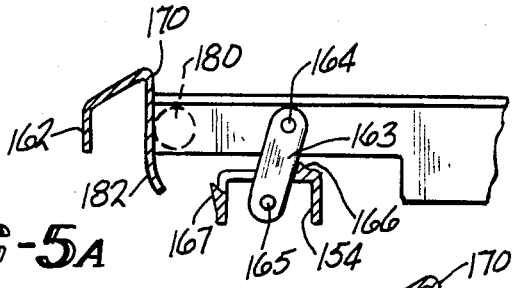

Referring now to FIG. 4 a second embodiment of a gate structure comprises a gate 140 supported adjacent its rearward end 152 from a carriage 154 by a pair of transversely separated struts 163, each of which is hingedly connected adjacent its upper end at 164 to gate 140 and adjacent its lower end at 165 to carriage 154, to permit the travel of struts 163 in the axial planes containing them. Stops 166, 167 are provided to limit the travel of struts 163. When a gate 140 is in its fully closed position with strut 163 in abutment with stop 166, strut 163 will be marginally forwardly inclined, as shown schematically in FIG. 50, thereby locking gate 140 in a fully closed position as carriage 154 moves forwardly from its position shown in FIG. 5*a*, strut 163 will flip to a rearwardly inclined position, to unlock the gate. During this movement of carriage 154, gate 140 will remain closed, as shown in FIG. 5*b*.

Figure 5B:
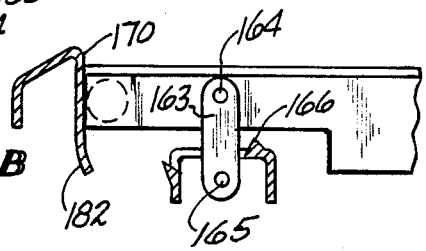
Figure 5C:
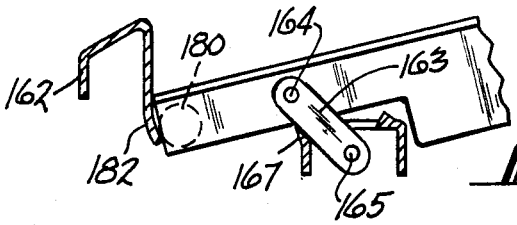

Still further movement of carriage 154 will cause the rearward end 152 of gate 140 to move downwardly to a partially opened position, without inducing any significant degree of forward movement of the gate, until such time as strut 163 abuts stop 167, as in FIG. 5*c*. Preferably the forward facing wall 170 of hogback 162 is windowed in lower portions 171 thereof, so as not to impede the flow of particulate material from hopper 14 when gate 140 is in its initial stages of opening, which is to say in positions intermediate those shown in FIGS. 5*b* and 5*c*.

It will be appreciated that the movement of gate 140 from its closed but unlocked position as shown in FIG. 5*b* to its partially open position as shown in FIG. 5*c* is assisted by the weight of the particulate material bearing thereon, and that the energy requirement for moving carriage 154 to procure the partial opening of gate 140 is low. Indeed, energy may be required to resist the movement of the gate, when it is unlocked, towards its partially opened position.

When strut 163 comes into abutment with stop 167, gate 140 assumes a stable condition which will be maintained without the application of power to hydraulic cylinders 80. For certain particulate materials which are relatively free flowing, the partial opening of gate 140 to the stable position assumed in FIG. 5*c* is adequate for the discharge of the material from hopper 14, and the gate opening system may be shut down to conserve energy. In those instances where it is desired to open gate 140 still further, hydraulic cylinders 80 will be actuated to move carriage 154 forwardly, thereby causing gate 140 to undergo a forward movement and to function as described in connection wtih the first embodiment.

Figure 5D:
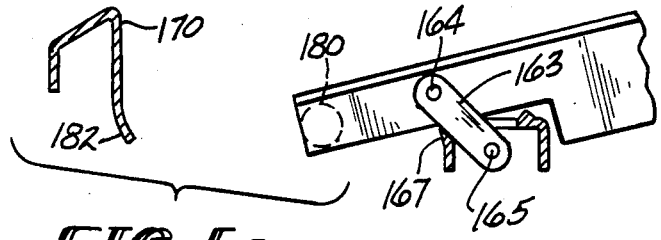

Assuming gate 140 to be in an open position, as shown in FIG. 5*d*, the rearward movement of carriage 154 will entrain gate 140, with strut 163 in abutment with stop 167, until such time as gate 140 meets with a substantial resistance to closure, whereupon strut 163 will pivot about its lower hinge point 165, to lift the rearward end of gate 140, reversing the action earlier defined with respect to FIGS. 5*c* and 5*b*, thereby closing the gate. Still further rearward movement of carriage 154 will cause strut 163 to move overcentre and to flop into abutment with stop 165, thereby locking gate 140 in its closed position. It will be appreciated that in such locked condition, the hydraulic system may be shut down, as the weight of the gate 140 and any particulate material in hopper 14 will exert a strong biasing force to maintain strut 163 in its locked position.

In order to assist the upward movement of the rear end of gate 140 as it moves from its position shown in FIG. 5*c* to that shown in FIG. 5*b*, gate 140 is provided with rollers 180 on the underside thereof, which contact slide bars 182 on forward face 170 of hogback 162. Preferably at least the lower portions of slide bars 182 are provided with an upwardly rearwardly inclined cam surface to assist in providing a translational movement, particularly where strut 163, when in abutment with stop 167, subtends an angle of less than about 45 degrees to the horizontal.

The foregoing preferred embodiments of my invention are intended to be illustrative only thereof. It will be apparent that many changes may be made thereto, and the claims appended hereto are intended to cover such changes.

I claim:

1. Apparatus for handling particulate material comprising:

wall structure including hopper walls having an axially elongated throat opening therein for the discharge of said particulate material therethrough;

an axially aligned track supported from said wall structure;

at least one gate for closing at least a portion of said throat opening;

means movable along said track supporting said gate therefrom adjacent one end thereof;

means supporting the other end of said gate whereby as said one end is moved in a direction to open said gate, the other end moves upwardly above the level of said throat opening, and means for moving said gate between open and closed positions.

2. Apparatus as defined in claim 1, wherein said track is located on the discharge side of said gate.

3. Apparatus as defined in claim 1, wherein said means supporting the other end of said gate comprises a movement translator.

4. Apparatus as defined in claim 3, wherein said movement translator is a cam.

5. Apparatus as defined in claim 4, wherein said cam is axially elongated and is secured to the discharge side of said gate.

6. Apparatus as defined in claim 4, wherein said cam is formed as a sub floor of said gate.

7. Apparatus as defined in claim 4, wherein said cam is supported on a roller.

8. Apparatus as defined in claim 4, wherein said cam is formed as a generally circular arc having a radius equal to about ⅔rds the axial length of said gate.

9. Apparatus as defined in claim 4, wherein said cam is supported on a roller mounted on a lateral element bridging said throat opening to provide a seal therebetween and said one gate.

10. Apparatus as defined in claim 1, further comprising at least a second gate adjacent said one gate, and wherein upward movement of the other end of said one gate is at least in part vertically above the portion of the throat opening normally closed by the second gate.

11. Apparatus as claimed in claim 10, further comprising means for moving said second gate between open and closed positions operable independently of said means for moving said one gate between open and closed positions.

12. Apparatus as defined in claim 1, wherein said means movable along said track comprises a wheeled carriage.

13. Apparatus as defined in claim 12, wherein said means for moving said gate between open and closed positions is drivingly connected to said wheeled carriage.

14. Apparatus as defined in claim 1, wherein said gate is pivotally supported from said means movable along said track.

15. Apparatus as defined in claim 14, wherein means is provided for controlling the degree of rotation of said gate about its pivotal support.

16. Apparatus as defined in claim 1, wherein said axially aligned track and said means movable therealong include cooperating elements to resist lateral displacement of said one gate.

17. Apparatus as defined in claim 1, wherein said track comprises a pair of rails respectively spaced laterally outwardly from the lateral margins of said throat opening.

18. Apparatus as defined in claim 1, wherein said track comprises vertically spaced apart members.

19. Apparatus as defined in claim 1, wherein said hopper walls form the walls of a ship's hold.

20. Apparatus as defined in claim 1, further comprising at least a second gate adjacent said one gate, and wherein a lateral element is provided to bridge across said throat opening laterally and provided a seal between said one gate and said second gate.

21. Apparatus for discharging particulate material from above through a substantially horizontal hopper throat comprising:

a gate for closing at least a part of said throat;

an axially elongated track supported substantially horizontally beneath said hopper throat;

a gate-operating carriage for movement along said track between gate-open and gate-closed positions;

means connecting said gate adjacent one end thereof to said carriage whereby it is moved between open and closed positions;

means for supporting said gate adjacent the other end thereof to move said other end upwardly as said carriage is moved towards gate open position, and means for moving said carriage between gate-open and gate-closed positions.

22. Apparatus as defined in claim 21, wherein said means for connecting said gate to said carriage permits said one end of said gate to be raised or lowered with respect to said track.

23. Apparatus as defined in claim 22, wherein said means connecting said gate to said carriage serves at least in part to raise and lower said one end of said gate by translating the movement of said carriage.

24. Apparatus as defined in claim 22, wherein said one end of said gate is raised as said gate moves towards its shut position at least in part by cam means serving to translate movement of said carriage.

25. Apparaus as defined in claim 22, wherein said means for connecting said gate to said carriage comprises a link rotatable with respect to said gate and said carriage.

26. Apparatus as defined in claim 25, wherein said link is a toggle link having an overcentre movement and wherein movement of said carriage in a direction to close said gate moves said toggle to lock said gate.

27. Apparatus as defined in claim 26, further comprising stop means to limit the movement of said one end of said gate towards said track as said carriage moves in a direction to open said gate.

28. Apparatus as defined in claim 27, wherein said stop means is located to retain said gate in a partially opened condition.

29. Apparatus as defined in claim 21 wherein said hopper forms part of a ship's hold.

30. An apparatus for handling particulate material, comprising:

wall structure including hopper walls having an axially elongated throat opening therein for the discharge of said particulate material therethrough;

an axially aligned track supported from said wall structure;

at least one gate for closing at least a portion of said throat opening;

carriage means movable along said track supporting said gate therefrom adjacent one end thereof;

means supporting the other end of said gate whereby as said one end is moved in a direction to open said gate, the other end moves upwardly above the level of said throat opening;

means for moving said gate between open and closed positions;

a second gate adjacent to said one gate, a lateral element bridging across said throat opening laterally and providing a seal between said one gate and said second gate;

means for connecting said one gate to said carriage means serving at least in part to raise and lower said one end of said gate by translating the movement of the carriage means with respect to said track;

said means for connecting said gate to said carriage means comprising a link rotatable with respect to said gate and said carriage means, said link being a toggle link having an overcenter movement and wherein movement of the carriage means in a direction to close said one gate moves the toggle to lock said gate;

stop means to limit the movement of said one end of said one gate towards said track as said carriage moves in a direction to open said gate;

said stop means being located to retain said gate in a partially opened condition;

a wall surface defining said transverse element being windowed to permit particulate material to be discharged from said hopper when said one gate is in a partially opened condition.

* * * * *